United States Patent [19]

Wüster

[11] Patent Number: 4,676,381

[45] Date of Patent: Jun. 30, 1987

[54] CLOTHESLINE CLAMPING DEVICE FOR A CLOTHES DRYING APPARATUS

[76] Inventor: Heinrich Wüster, Auwerk 18, A-6460 Imst/Tirol, Austria

[21] Appl. No.: 772,657

[22] Filed: Sep. 4, 1985

[30] Foreign Application Priority Data

Sep. 7, 1984 [AT] Austria ..... 2874/84
Jul. 1, 1985 [AT] Austria ..... 1953/85

[51] Int. Cl.[4] ..... D06F 53/00
[52] U.S. Cl. ..... 211/119.01; 211/119.03
[58] Field of Search ..... 211/119.01, 119.02, 211/119.03, 119.04, 119.05, 119.06, 119.07, 119.08, 119.09, 119.10, 119.11, 119.12, 119.13, 119.14, 182, 183, 197; 135/25, 25 A, 36 R, 36 F

[56] References Cited

U.S. PATENT DOCUMENTS

| | | | |
|---|---|---|---|
| 1,063,283 | 6/1913 | Olander | 211/119.06 |
| 2,453,270 | 11/1948 | Russell | 135/36 F |
| 2,474,922 | 7/1949 | Unwin | 211/197 |
| 3,643,988 | 2/1972 | Ingvartsen | 211/182 |
| 3,660,872 | 5/1972 | Kawano | 135/36 F |
| 3,784,026 | 1/1974 | Grosse | 211/182 |
| 4,047,616 | 9/1977 | Seabrook | 211/197 |
| 4,550,840 | 11/1985 | Van Deursen | 211/119.01 |

FOREIGN PATENT DOCUMENTS

| | | | |
|---|---|---|---|
| 134253 | 3/1985 | European Pat. Off. | 211/119.01 |
| 2854501 | 6/1980 | Fed. Rep. of Germany | 211/197 |
| 1008535 | 2/1952 | France | 211/119.01 |
| 8200941 | 10/1983 | Netherlands | 211/119.01 |

*Primary Examiner*—Andrew V. Kundrat
*Assistant Examiner*—Anthony Knight
*Attorney, Agent, or Firm*—Kurt Kelman

[57] ABSTRACT

A clothes drying apparatus comprises a tubular post and a collapsible spider assembly supported on the tubular post. The spider assembly comprises an upper sleeve mounted on the post, a lower, slidable sleeve mounted on the post for displacement with respect to the upper sleeve, an array of collapsible main arms each having a free, outer end and an opposite inner end pivoted to the lower, slidable sleeve, a like array of auxiliary arms having their respective ends pivoted to the upper sleeve and the main arms, and a clothesline passing through openings in the main arms. A detachable clamping device at the outermost openings in the main arm adjacent the free, outer end thereof releasably retains the clothesline emerging from each opening, the clamping device comprising means for deflecting lengths of the clothesline emerging from each opening towards the main arm and clamping the deflected clothesline lengths against the main arm.

24 Claims, 11 Drawing Figures

CLOTHESLINE CLAMPING DEVICE FOR A CLOTHES DRYING APPARATUS

Figure 1:
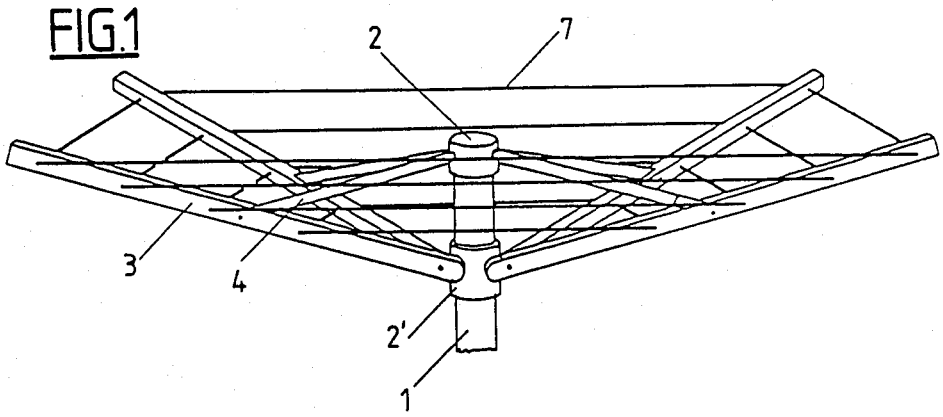

This invention relates to an apparatus for drying clothes, comprising a tubular post and a collapsible spider assembly supported on said tubular post. The spider assembly comprises an upper sleeve mounted on the post, a lower, slidable sleeve mounted on the post for displacement with respect to the upper sleeve, an array of collapsible main arms each having a free, outer end and an opposite inner end pivoted to the lower, slidable sleeve, and a like array of auxiliary arms having their respective ends pivoted to the upper sleeve to carry the clothesline and the main arms. A clothesline passes through openings for the clothesline, which passage openings are preferably provided with eyelets.

In conventional apparatus of this type for drying and airing clothes the tubular post is rotatably anchored in the ground and preferably four main arms, carry the clothesline secured thereto. The spiderlike assembly can be unfolded or folded together by the displacement of the slidable sleeves.

In the known apparatus, the clothesline extends through the hollow carrying arms in bores which are protected by plastic eyelets, and the clothesline is knotted at both ends. To facilitate the threading of the clothesline the eyelets must provide for an adequate play, which involves the disadvantage that when the spider assembly supports wet, heavy clothes in an irregular arrangement, the clothesline will slip in the direction of the heaviest load. As a result, carrying arms adjacent lengths of clothesline under a low load will be pulled toward each other whereas the opposite action will result in areas under a higher load. In practice this has the result that the initially entirely symmetrical distribution of the arms of the spider assembly in which, in a top plan view the clothesline defines concentric squares having diagonals defined by the carrying arms is changed to a rectangular configuration. If that deformation is not corrected in time by pulling the clothesline into the areas between adjacent arms which have been shortened, the enormous leverage exerted by the carrying arms will exert an extremely heavy load on the lugs of the sliding sleeves to which the carrying arms are pivoted. This results in a faster wear and in case of suddenly occurring wind loads may result in a breakage of the sliding sleeves or carrying arms at the articulated joint.

Published German Application No. 28 54 501 describes detachable retaining clips, which are clipped to the line and are arranged closely before or behind the carrying arms and are intended to prevent a slipping of the line. The same result is intended to be produced by retaining clips which are different in form and similar to an open clip which is directly mounted on the carrying arm.

In practice, the design of the retaining clips effects only a small deflection of the clothesline so that they add only slightly to the friction and cannot fix the relatively smooth clothesline under the forces which occur. Almost all clotheslines on the market consist of a synthetic fiber core for taking up the tensile load and a flexible sheath of a plastic material which is as resistant as possible to the weather and to low temperature and which should be as smooth as possible so that contaminations which are due to the environment can simply be wiped off before clothes are hung on the line.

Because the described retaining clips are independently attached to the clothesline, they cannot support each other. As a result, the retaining force is small and the retaining clips must be rather heavy so that they are expensive. A further disadvantage resides in that the clips may be lost in case of a strong wind and sudden loading.

While it is theoretically possible to retension the clothesline, as is required, by individually detaching all retaining clips and then individually re-applying them after the line has been retensioned, this is a highly time-consuming operation.

Published German Application No. 31 39 033 describes an attempt to effect a clamping of the clothesline by a suitable design of caps attached to the ends of the carrying arms. It is intended to clamp the clothesline by means of an extension integrally formed on the end cap and protruding into the interior of the tubular carrying arm. In one embodiment the clothesline is clamped in a tapering slot. In another embodiment the clothesline is forced against the inside surface of the tubular arm.

Both embodiments have not proved satisfactory in practice because the design precludes a deflection of the clothesline owing to the confined space and the retensioning of the clothesline is extremely impractical. In the first embodiment which comprises a tapering slot which extends at right angles to the direction of the tension of the clothesline, no self-clamping effect which would increase the initial retaining force can be achieved by a tensile force exerted on the clothesline. For this reason it is almost impossible to fix the clothesline by means of the cap as the clothesline cannot be supported in the interior of the tubular arm against the clamping extension of the cap, which is to be forced into tubular arm. The embodiment in which the clothesline is forced against the inside surface of the tubular arm cannot be used in practice either. If the carrying arm is tubular, as is essential for the mounting of an inwardly protruding end cap, the clothesline extending through the sharp-edged bores of the carrying arm must be protected by means of liners. By the clamping extension attached to the cap, the clotheline ought to be forced against said liners so that the liner, which has been introduced from the outside, will be forced out. Nevertheless it is not possible without a deflection of the clothesline to force the latter against the inside surface of the smooth tubular arm in such a manner that the clothesline will reliably be held.

The proposals which have been made also fail to meet practical requirements when a retensioning of the clothesline is required. In that case the end caps which have been forced into the carrying arms would have to be pulled out by means of a suitable tool in order to eliminate the clamping before the clothesline can be retensioned or replaced and the end caps must subsequently be forced into the carrying arms with the force which is required for a reliable fixation.

It is an object of the present invention to provide for a reliable fixation of the clothesline on the carrying arms by inexpensive means while the disadvantages which have been described are avoided.

That object is accomplished in accordance with the invention with clamping members deflecting the clothesline emerging from the passage openings in the main arms and fitted on the main arms at their outermost passage openings to clamp the deflected clothesline against the associated main arm.

That design permits a direct application of force from the clothesline to the associated main arm of the spider assembly and ensures that even a smooth clothesline will adequately be fixed to the main arm without a need for a clamping member which has sharp edges which would damage the clothesline. Because that clamping is effected at the ends of the main arm, the existing leverage will prevent a canting of the main arms. When the clothesline is to be retensioned, the clamping members are removed from the main arm and are re-applied after the retensioning.

In accordance with a further feature of the invention, the clamping member comprises a retaining portion which embraces the main arm, and a clamping portion, which forces the deflected clothesline against the main arm.

Also in accordance with the invention, the retaining portion may consist of an end cap, which is fitted on the end of the main arm, and the clamping portion may consist of a U-shaped clip, which is articulated to the end cap. When the end caps have been applied to the free ends of the main arms and the clothesline has subsequently been threaded into the end caps, the pivoted U-shaped clip is forced toward the main arm and the integrally formed legs of the U-shaped clip force the clothesline on both sides against the outside surfaces of the main arm.

In accordance with a further feature of the invention, the clamping portion consists of a U-shaped clip which embraces the main arm and which clamps between its legs and the main arm the clothesline which has been deflected away from the U-shaped clip at the passage opening. That design will be advantageous at passage openings which are remote from the outer end of the associated main arm.

Also within the scope of the invention, the clamping member or its clamping portion may be fitted on those portions of the clothesline which emerge from the passage opening and at said passage opening are deflected toward the clamping member or clamping portion, and said clamping member or clamping portion comprises a centrally disposed deflecting slot for redeflecting both portions of the clothesline. In that design, the frictional force is further increased because the portions of the clothesline are redeflected. The clothesline is deflected so often that in this embodiment the transmitted clamping force will be stronger under all loading conditions than the inherent strength of the clothesline although all edges at which the clothesline is deflected are rounded so that damage to the clothesline will be prevented under all circumstances. A significant advantage afforded by this embodiment resides in that it is self-clamping and in case of an increasing tensile load on the clothesline the clamping member will be forced with increasing strength against the profiled arm and the interposed clothesline.

In accordance with a further feature of the invention, the clamping member or its clamping portion is formed with a slot which opens from the outside into the deflecting slot and serves to facilitate the insertion of the clothesline. That design will facilitate the retensioning of the clothesline as well as the threading of a new clothesline.

In another embodiment of the invention, the clamping member consists of a retaining portion, which is fitted on the main arm as an end cap, and a U-shaped clip, which is articulated to the end cap and partly embraces the main arm and causes the clothesline which is deflected at the outermost passage openings to be clamped between the U-shaped clip and the main arm. This design has the advantage that the profiled main arm is closed at its free end whereas the end cap does not embrace the main arm and the U-shaped clip itself is fitted on the main arm.

If the clamping member is made of plastic, the articulated joint between the end cap and the U-shaped clip may consist of a strap hinge.

In accordance with a further feature of the invention, the main arm is channel-shaped and the U-shaped clip bridges the open top of the channel and has two slots, which receive and preferably clamp the side walls of the channel and each of which is defined by a leg, which engages the main arm on the outside, and a projection, which is provided on the U-shaped clip and protrudes into the interior of the main arm. That design results in a stronger retaining force between the U-shaped clip and the main arm; that force can be further improved if the side walls of the main arm have thickened ends and are interengaged by hook-like projections of the U-shaped clip.

To ensure that the U-shaped clip will be forced down by the clothesline against the main arm, a further feature of the invention resides in that the U-shaped clip is formed in its web with a centrally disposed transverse slot. Said web bridges the open top of the channel-shaped main arm, and said transverse slot opens toward the outside through a centrally disposed longitudinal slot. In that embodiment, the clotheline is introduced into the transverse slot through the longitudinal slot so that when the U-shaped clip has been clamped on the main arm, the clothesline is deflected outwardly at the ends of the transverse slot and the U-shaped clip is thus forced more strongly against the main arm by the tensile load on the clothesline.

Figure 2:
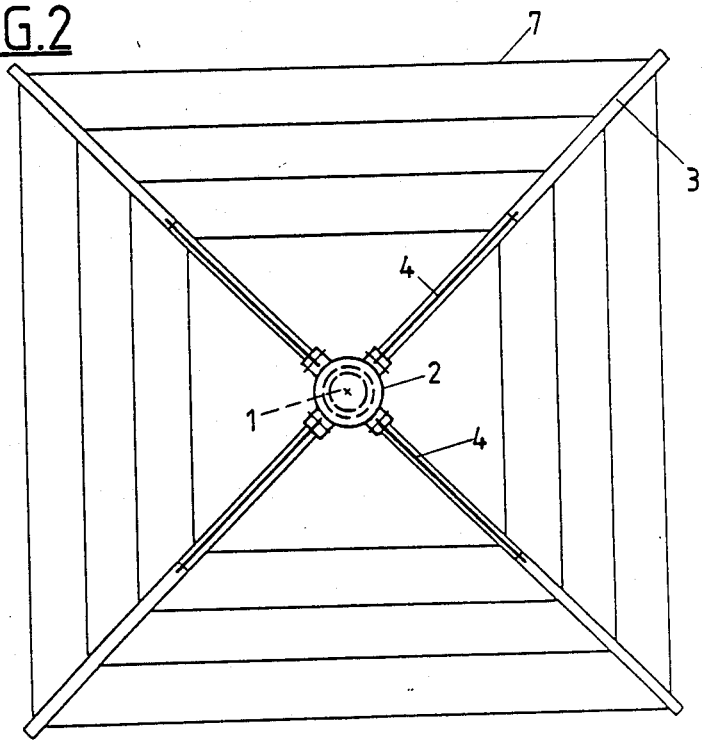
Figure 9:
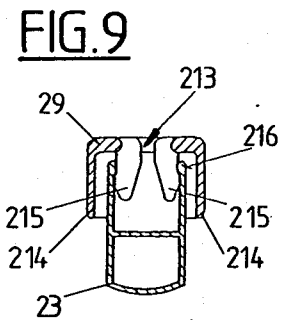
Figure 11:
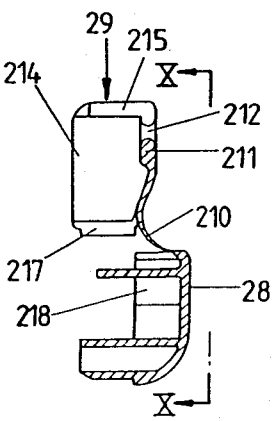
Figure 8:
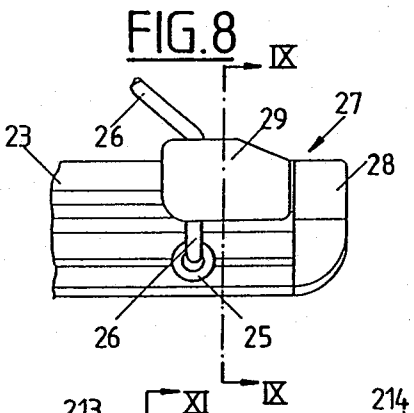
Figure 10:
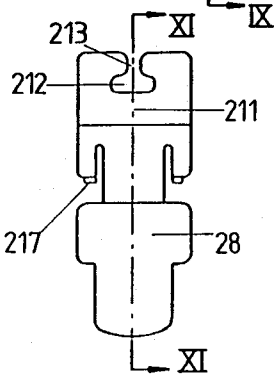
Figure 4:
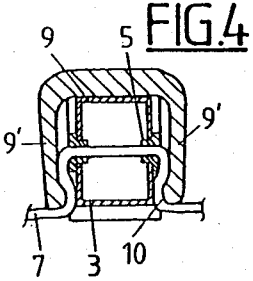
Figure 3:
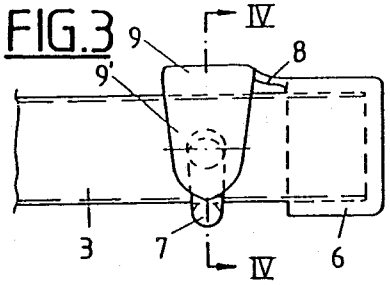
Figure 6:
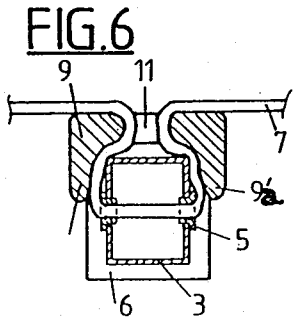
Figure 5:
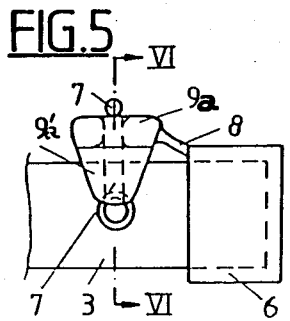
Figure 7:
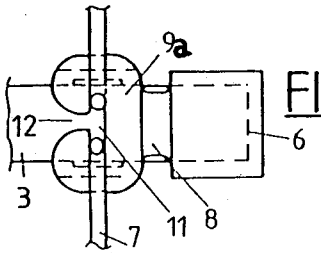

The invention will now be explained with reference to illustrative embodiments shown on the drawings, in which FIG. 1 is a perspective view showing an apparatus for drying clothes, FIG. 2 is a top plan view of the clothes drying apparatus of FIG. 1, FIG. 3 is an elevation showing a first embodiment of a clamping member which is integrally formed with an end cap, FIG. 4 is a sectional view along line IV—IV of FIG. 3, FIG. 5 is an elevation showing a second embodiment of a clamping member provided with an end cap, FIG. 6 is a sectional view along line VI—VI of FIG. 5, FIG. 7 is a top plan view showing the clamping member of FIG. 5, FIG. 8 is an elevation showing the end of a main arm of a collapsible spider array of arms of another embodiment of the apparatus for drying clothes in accordance with the invention, FIG. 9 is a sectional view along line IX—IX showing a part of the clamping member of FIG. 8, FIG. 10 is an end view of the clamping member of FIG. 9, and FIG. 11 is a sectional view along line XI—XI of FIG. 10.

In accordance with FIG. 1 the apparatus for drying clothes comprises a tubular post 1, and a collapsible spider assembly supported on the post. This spider assembly is shown to comprise upper sleeve 2 mounted on post 1, lower slidable sleeve 2' displaceable on the post, an array of collapsible main arms 3 having one of their ends pivoted to slidable sleeve 2' and a like array of auxiliary arms 4 having their respective ends pivoted to sleeve 2 and main arms 3. The clothesline 7 passes through passage openings lined by eyelets 5 and the free ends of main arms 3 are closed by end caps 6 (see FIGS. 5 and 6).

In the embodiment of FIG. 3, the end cap 6 is connected by a strap hinge 8 to 9 clamping member 9, the clothesline 7 emerging from eyelets 5 is deflected twice 90 degrees by the clamping member and is clamped and thus fixed between the legs 9' of the clamping member and the main arm 3, as shown in FIG. 4. The legs 9' are provided at their free ends with inwardly protruding beads 10, to provide a snap connection of the clamping member with the main arm behind eyelets 5. To release the clamping action, the clamping member 9 is pivotally raised about strap hinge 8. FIGS. 5 to 7 show an alternative embodiment of the clamping member. Clamping member 9*a* is formed with an elongated deflecting slot 11 and a tapered insertion slot 12, which extends at right angles to the deflecting slot 11. When the end cap 6 has been attached and the clothesline 7 has been threaded through eyelets 5, the latter is first introduced through the insertion slot 12 into the elongated slot 11 before the clamping member 9 is forced onto the main arm. As a result, the clothesline 7 emerging from the eyelets 5 is upwardly deflected and is then forced by the clamping member 9*a* against the main arm 3 and subsequently emerges from the clamping member 9*a* when the clothesline has been redeflected by the deflecting slot 11.

In the embodiments illustrated by way of example and end caps constitute retaining portions of the clamping member. It will be understood that the retaining portion may alternatively be constituted by a U-shaped member which embraces the main arm 3, or the retaining portion of the clamping member may be secured to the main arm by riveting or otherwise.

In the embodiment of the clothesline clamping device shown by way of example in FIGS. 8 to 11, main arms 23 comprise eyelets 25 defining passage openings for a clothesline 26 fixed to main arm 23 by means of a clamping member 27, which is attached to the free end of the main arm 23. The clamping member 27 consists of an end cap 28, which has been fitted into and closes the end of the main arm 23, and a U-shaped clip 29, which is articulated to the end cap and straddles the main arm 23. The clothesline 26 is deflected by the clips as it emerges from eyelets 25, and is clamped between the U-shaped clip 29 and the main arm 23.

The main arm 23 may consist of an aluminum channel over whose open side the U-shaped clip 29 has been fitted whereas the clothesline 26 extends through the main arm 23 on the closed side of the channel.

FIGS. 10 and 11 show the U-shaped clip 29 pivotally raised. The clip is connected to the end cap 28 by a strap hinge 210. The web 211 of the U-shaped clip 29 bridges the open side of the channel-shaped main arm and is formed with a centrally disposed transverse slot 212, through which the clothesline 26 can be threaded, and with a centrally disposed longitudinal slot 213, which extends outwardly from the transverse slot 212 and is used to insert the clothesline 26. Projections 215 which are parallel to the two legs 214 of the U-shaped clip 29 are provided at the outer end of the longitudinal slot 213 and extend into the interior of the profiled main arm and together with the legs 214 define respective slots 216 for receiving the side walls of the channel-shaped main arm. That slot may be partly constricted by hooklike projections so that the side wall is pinched in slot 216.

To fix the clothesline 26, those portions of the clothesline emerging from eyelets 25 of the main arm 23 on both sides are upwardly bent toward the side walls of the main arm and are threaded through the longitudinal slot 213 into the transverse slot 212 of the U-shaped clip 29, which has been pivotally raised.

Thereafter the U-shaped clip 29 is forced down onto the profiled main arm so that the clothesline 29 is clamped between the inside surfaces of the legs 214 and the outside surfaces of the side walls of the channel and is inwardly deflected over the upper edge of the side walls of the channel and outwardly deflected at the ends of the transverse slot.

As the U-shaped clip is depressed, the side walls of the channel enter the slots 216 and ribs 217 provided at the ends of the U-shaped clip 29 enter apertures 218 formed in the end cap 28. Said ribs may be so designed that they will resiliently interlock with the end cap 28 when the U-shaped clip 29 has been depressed.

I claim:

1. A clothes drying apparatus comprising
(a) a tubular post,
(b) a collapsible spider assembly supported on the tubular post, the spider assembly comprising
(1) an upper sleeve mounted on the post,
(2) a lower, slidable sleeve mounted on the post for displacement with respect to the upper sleeve,
(3) an array of collapsible main arms each having a free, outer end and an opposite inner end pivotably connected to the lower, slidable sleeve,
(4) a second array of auxiliary arms having their respective opposite ends pivotally connected to the upper sleeve and the main arms, and
(5) a clothesline passing through openings in the main arms, and
(c) a detachable clamping device at outermost ones of the openings in the main arm adjacent the free, outer end thereof for releasably retaining the clothesline emerging from each opening, the clamping device comprising means for deflecting lengths of the clothesline emerging from each opening towards the main arm and clamping the deflected clothesline lengths against the main arm.

2. The clothes drying apparatus of claim 1, wherein the clamping device comprises a retaining portion affixed to the main arm, and the clamping device means is a substantially U-shaped clamping member movably connected to the retaining portion for attachment to, and detachment from, the main arm, the clamping member partially embracing the main arm in the attached position at the outermost openings for deflecting and clamping the deflected clothesline lengths between the main arm and the clamping member.

3. The clothes drying apparatus of claim 2, further comprising a strap hinge pivotally connecting the clamping member to the retaining portion.

4. The clothes drying apparatus of claim 2, further comprising eyelets inserted in the openings of the main arms for guiding the clothesline, and wherein the clamping member has inwardly projecting beads forming a snap connection with the main arm behind the eyelets in the outermost openings, the deflected clothesline lengths being clamped between the beads and the main arm.

5. The clothes drying apparatus of claim 1, wherein the clamping device means is a clamping member comprising a retaining portion embracing the main arm and a U-shaped clamping clip clamping the deflected clothesline lengths to the main arm.

6. The clothes drying apparatus of claim 5, further comprising a strap hinge pivotally connecting the clamping claip to the retaining portion.

7. The clothes drying apparatus of claim 5, further comprising eyelets inserted in the openings of the main arms for guiding the clothesline, and wherein the clamping member has inwardly projecting beads forming a snap connection with the main arm behind the eyelets in the outermost openings, the deflected clothesline lengths being clamped between the beads and the main arm.

8. The clothes drying apparatus of claim 1, wherein the clamping device comprises an end cap mounted on the free, outer end of the main arm and the clamping device means is a U-shaped clamping member pivotally connected to the end cap and clamping the deflected lengths of the clothesline emerging from each opening against the main arm.

9. The clothes drying apparatus of claim 8, further comprising a strap hinge pivotally connecting the clamping member to the retaining portion.

10. The clothes drying apparatus of claim 8, further comprising eyelets inserted in the openings of the main arms for guiding the clothesline, and wherein the clamping member has inwardly projecting beads forming a snap connection with the main arm behind the eyelets in the outermost openings, the deflected clothesline lengths being clamped between the beads and the main arm.

11. The clothes drying apparatus of claim 1, wherein the main arm is a profiled element of channel-shaped cross section having two side walls and an open top, and the clamping device comprises an end cap mounted on the free, outer end of the main arm and the clamping device means is a U-shaped clamping member pivotally connected to the end cap and having a web bridging over the open top, the U-shaped clamping member having two outer legs engaging the side walls of the profiled element and two inwardly extending projections, the side walls being received in slots defined between the legs and inwardly extending projections.

12. The clothes drying apparatus of claim 11, further comprising a strap hinge pivotally connecting the clamping member to the end cap.

13. The clothes drying apparatus of claim 11, wherein the web of the U-shaped clamping member defines a centrally disposed transverse slot and a centrally disposed longitudinal slot leading outwardly from the transverse slot.

14. The clothes drying apparatus of claim 11, wherein the side walls are clamped in the slots defined between the legs and inwardly extending projections.

15. The clothes drying apparatus of claim 1, wherein the clamping device means is a clamping member mounted on the main arm and clamping the deflected clothesline lengths against the main arm, the clamping member defining a centrally disposed deflecting slot for re-deflecting the deflected clothesline lengths.

16. The clothes drying apparatus of claim 15, wherein the clamping member defines a threading slot leading into the deflecting slot for threading the clothesline into the deflecting slot.

17. The clothes drying apparatus of claim 15, wherein the clamping member is C-shaped and has a base and two legs, the base of the clamping member defining the deflecting slot and the legs of the clamping member pressing the deflected clothesline lengths against the side walls of the main arm, the length of the deflecting slot in a direction transverse to the width of the main arm being shorter than the width of the main arm for further deflecting the clothesline lengths at each longitudinal edge of the main arm.

18. The clothes drying apparatus of claim 17, wherein the clamping member defines a threading slot leading into the deflecting slot for threading the clothesline into the deflecting slot.

19. The clothes drying apparatus of claim 1, wherein the clamping device comprises an end cap mounted on the free, outer end of the main arm and the clamping device means is a U-shaped clamping member pivotally connected to the end cap and mounted over the deflected clothesline lengths on the main arm, the clamping member defining a centrally disposed slot for re-deflecting the deflected clothesline lengths.

20. The clothes drying apparatus of claim 19, wherein the clamping member defines a threading slot leading into the deflecting slot for threading the clothesline into the deflecting slot.

21. The clothes drying apparatus of claim 19, further comprising a strap hinge pivotally connecting the clamping member to the end cap.

22. The clothes drying apparatus of claim 19, wherein the clamping member is C-shaped and has a base and two legs, the base of the clamping member defining the deflecting slot and the legs of the clamping member pressing the deflected clothesline lengths against the side walls of the main arm, the length of the deflecting slot in a direction transverse to the width of the main arm being shorter than the width of the main arm for further deflecting the clothesline lengths at each longitudinal edge of the main arm.

23. The clothes drying apparatus of claim 22, wherein the clamping member defines a threading slot leading into the deflecting slot for threading the clothesline into the deflecting slot.

24. The clothes drying apparatus of claim 22, further comprising a strap hinge pivotally connecting the clamping member to the end cap.

* * * * *